US009671181B2

(12) United States Patent
Janezich et al.

(10) Patent No.: US 9,671,181 B2
(45) Date of Patent: Jun. 6, 2017

(54) HEAT EXCHANGER WITH IMPROVED TANK AND TUBE CONSTRUCTION

(75) Inventors: Robert Janezich, Hibbing, MN (US); Aaron Patrick Morgan, Britt, MN (US); Charles Eugene Cedar, Jr., Chisholm, MN (US); Todd Gregory Dosen, Side Lake, MN (US)

(73) Assignee: L&M Radiator, Inc., Hibbing, MN (US)

( * ) Notice: Subject to any disclaimer, the term of this patent is extended or adjusted under 35 U.S.C. 154(b) by 689 days.

(21) Appl. No.: 13/249,931

(22) Filed: Sep. 30, 2011

(65) Prior Publication Data

US 2013/0081795 A1 Apr. 4, 2013

(51) Int. Cl.

| | |
|---|---|
| ***F28F 9/02*** | (2006.01) |
| ***F28F 9/04*** | (2006.01) |
| ***F28F 1/42*** | (2006.01) |
| ***F28F 1/02*** | (2006.01) |
| ***F28F 13/12*** | (2006.01) |
| ***F28F 9/22*** | (2006.01) |
| ***F28F 13/02*** | (2006.01) |
| ***F28D 1/053*** | (2006.01) |
| *F28F 9/26* | (2006.01) |

(52) U.S. Cl.

CPC ..... *F28F 9/0221* (2013.01); *F28F 9/04* (2013.01); *F28D 1/05366* (2013.01); *F28F 1/022* (2013.01); *F28F 1/42* (2013.01); *F28F 9/02* (2013.01); *F28F 9/0224* (2013.01); *F28F 9/0246* (2013.01); *F28F 9/262* (2013.01); *F28F 13/02* (2013.01); *F28F 13/12* (2013.01); *F28F 2230/00* (2013.01)

(58) Field of Classification Search

CPC .. F28F 9/0224; F28F 9/02; F28F 13/12; F28F 9/0246; F28F 9/262; F28F 13/02

USPC ..... 165/109.1, 173, 175, 178, 144

See application file for complete search history.

(56) References Cited

U.S. PATENT DOCUMENTS

| | | | | | |
|---|---|---|---|---|---|
| 1,416,337 | A | * | 5/1922 | Deane | 165/76 |
| 1,797,524 | A | * | 3/1931 | Dwyer | 165/76 |
| 1,886,645 | A | * | 11/1932 | Clarkson | 165/82 |
| 2,065,515 | A | * | 12/1936 | Cornell, Jr | 165/83 |
| 2,677,394 | A | * | 5/1954 | Brinen et al. | 138/38 |
| 2,688,986 | A | * | 9/1954 | O'Brien | 138/38 |
| 3,391,732 | A | * | 7/1968 | Murray | F28D 1/0535 165/148 |
| 3,527,291 | A | * | 9/1970 | Neary et al. | 165/83 |
| 4,106,558 | A | * | 8/1978 | Neveux | 165/109.1 |
| 4,146,088 | A | * | 3/1979 | Pain | F28D 7/103 165/141 |
| 4,236,577 | A | * | 12/1980 | Neudeck | 165/175 |
| 4,344,478 | A | * | 8/1982 | Petaja et al. | 165/69 |

(Continued)

*Primary Examiner* — Justin Jonaitis
*Assistant Examiner* — Joel Attey
(74) *Attorney, Agent, or Firm* — Banner & Witcoff, Ltd.

(57) ABSTRACT

A heat exchanger assembly includes a first tank having a tube side wall and a first reservoir. A first row of apertures extends through the tube side wall of the first tank. A first mounting block is secured to the first tank and has a first aperture. A second tank has a tube side wall and a second reservoir with a second row of apertures extending through its tube side wall. A second mounting block is secured to the second tank with a second aperture extending therethrough. A flow tube with a plurality of fins is received in the first aperture of the first block and the second aperture of the second block.

16 Claims, 4 Drawing Sheets

(56) References Cited

U.S. PATENT DOCUMENTS

| | | | | | |
|---|---|---|---|---|---|
| 4,441,547 | A | * | 4/1984 | Argyle et al. | 165/67 |
| 4,524,823 | A | * | 6/1985 | Hummel et al. | 165/174 |
| 4,709,689 | A | * | 12/1987 | Simcox | 126/665 |
| 4,727,907 | A | * | 3/1988 | Duncan | 138/38 |
| 5,342,470 | A | * | 8/1994 | Meirana | 156/304.2 |
| 5,433,268 | A | * | 7/1995 | Janezich et al. | 165/76 |
| 5,562,153 | A | * | 10/1996 | Sasaki | 165/76 |
| 5,782,291 | A | * | 7/1998 | Morita | 165/76 |
| 6,161,614 | A | * | 12/2000 | Woodhull et al. | 165/149 |
| 6,964,297 | B1 | * | 11/2005 | Janezich et al. | 165/178 |
| 7,481,266 | B2 | * | 1/2009 | Demuth et al. | 165/176 |
| 7,562,697 | B2 | * | 7/2009 | Gorbounov et al. | 165/174 |
| 2003/0221819 | A1 | * | 12/2003 | Jang | 165/173 |
| 2006/0037740 | A1 | * | 2/2006 | Durr et al. | 165/176 |
| 2007/0209386 | A1 | * | 9/2007 | Higashiyama et al. | 62/515 |
| 2008/0000625 | A1 | * | 1/2008 | Baylis et al. | 165/173 |
| 2008/0264503 | A1 | * | 10/2008 | Smith | 137/614.04 |
| 2009/0095458 | A1 | * | 4/2009 | Lim et al. | 165/174 |
| 2009/0120625 | A1 | * | 5/2009 | Janezich | 165/173 |
| 2009/0282850 | A1 | * | 11/2009 | Higashiyama | 62/239 |
| 2010/0147501 | A1 | * | 6/2010 | Art et al. | 165/175 |

* cited by examiner

HEAT EXCHANGER WITH IMPROVED TANK AND TUBE CONSTRUCTION

FIELD

Aspects of this invention relate generally to heat exchangers, and, in particular, to heat exchangers with tank and tube-and-fin assemblies, having improved tank construction and improved tube-to-tank sealing arrangements.

BACKGROUND

Heat exchangers typically are formed of a plurality of tube-and-fin assemblies, which are mounted and interconnected to a pair of opposed tanks. A heating or cooling fluid, e.g., oil, air, etc. flows from one tank into and through the tubes and then out through the second tank. Air is passed over the tubes and fins to add or remove heat from the fluid passing through the tubes. The heat exchanger must be able to withstand system operating pressures without leaking Elastomeric seals, or seals of other materials, are sometimes used within the heat exchanger to provide suitable sealing between the tubes and the tanks.

It would be desirable to provide a heat exchanger that reduces or overcomes some or all of the difficulties inherent in prior known devices. Particular advantages will be apparent to those skilled in the art, that is, those who are knowledgeable or experienced in this field of technology, in view of the following disclosure of the invention and detailed description of certain embodiments.

Particular objects and advantages of the invention will be apparent to those skilled in the art, that is, those who are knowledgeable or experienced in this field of technology, in view of the following disclosure of the invention and detailed description of certain preferred embodiments.

SUMMARY

Aspects of the present invention may be used to advantageously provide a heat exchanger having advantageous pressure capabilities and improved performance.

In accordance with a first aspect, a heat exchanger assembly includes a first tank having a tube side wall and a first reservoir. A first row of apertures extends through the tube side wall of the first tank. A first mounting block is secured to the first tank and has a first aperture. A second tank has a tube side wall and a second reservoir with a second row of apertures extending through its tube side wall. A second mounting block is secured to the second tank with a second aperture extending therethrough. A flow tube with a plurality of fins is received in the first aperture of the first block and the second aperture of the second block.

In accordance with another aspect, a heat exchanger assembly includes a first tank having a tube side wall, a tank side wall, a first reservoir formed therein, and a first web extending between the tube side wall and the tank side wall defining first and second portions of the first reservoir. A plurality of first rows of apertures extend through the tube side wall of the first tank. Each of a plurality of first mounting blocks is secured to the first tank, with each mounting block having a first aperture extending therethrough. Each of a plurality of flow tubes has a plurality of fins on an exterior surface thereof, a first end, and a second end, the first end being received in the first aperture of a corresponding first mounting block. A second tank has a tube side wall, a tank side wall, a second reservoir formed therein, and a second web extending between the tube side wall and the tank side wall defining first and second portions of the second reservoir. A plurality of second rows of apertures extend through the tube side wall of the second tank. Each of a plurality of second mounting blocks is secured to the second tank, with each second mounting block having a second aperture extending therethrough, the second end of one of the flow tubes being received in the second aperture of each of the second mounting blocks From the foregoing disclosure, it will be readily apparent to those skilled in the art, that is, those who are knowledgeable or experienced in this area of technology, that preferred embodiments of a heat exchanger as disclosed herein provide a significant technological advance in terms of improved sealing and performance at high operating pressures. These and additional features and advantages will be further understood from the following detailed disclosure of certain preferred embodiments.

Figure 1:
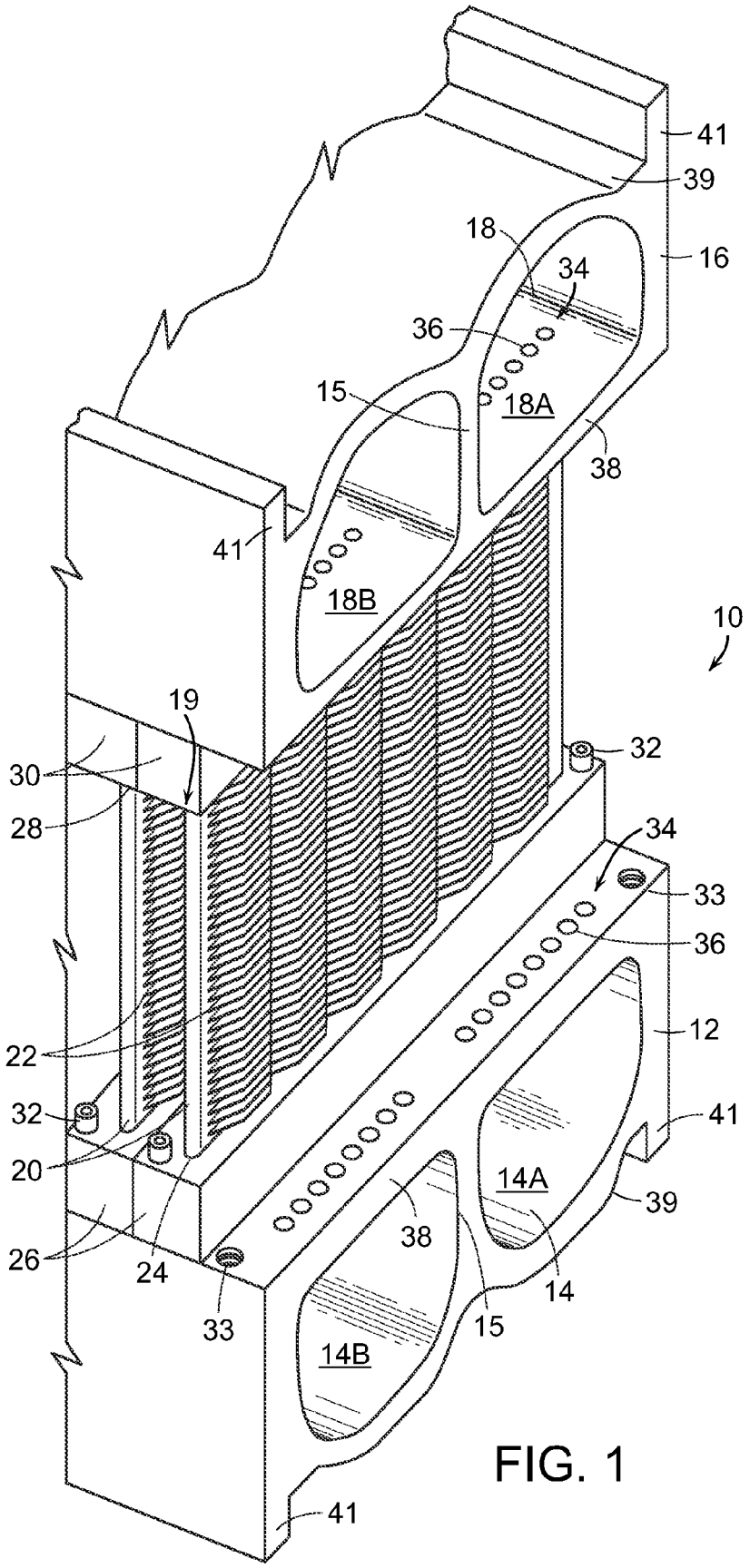
FIG. 1 is a schematic perspective view, shown partially broken away and partially assembled, of a plurality of tube-and-fin assemblies mounted between opposed tanks of a heat exchanger.

The figures referred to above are not drawn necessarily to scale and should be understood to provide a representation of the invention, illustrative of the principles involved. Some features of the heat exchanger depicted in the drawings have been enlarged or distorted relative to others to facilitate explanation and understanding. The same reference numbers are used in the drawings for similar or identical components and features shown in various alternative embodiments. Heat exchangers as disclosed herein would have configurations and components determined, in part, by the intended application and environment in which they are used.

DETAILED DESCRIPTION OF CERTAIN PREFERRED EMBODIMENTS

The present invention may be embodied in various forms. An embodiment of a heat exchanger 10 is shown in FIG. 1, partially assembled and partially cut away, and is used to cool hot fluid, e.g., oil or air, generated in the use of industrial machinery, e.g., a hydraulic transmission, compressor, or turbocharger (not shown). It is to be appreciated that heat exchanger 10 could be used in certain embodiments to heat a cool fluid. In a typical application, hot fluid would flow through the inside of heat exchanger 10, while a cooling fluid such as air or another suitable cooling fluid would contact the outside of heat exchanger 10 thereby cooling the hot fluid.

It is to be understood, however, that the heat exchanger is not limited to use in cooling hot fluid in industrial machinery, and may easily be used with fluids or gases in other fields. For example, embodiments of the present invention find application in heat exchangers such as radiators used to cool an engine where coolant, such as water or antifreeze, flows through flow tubes and fluid such as air or a suitable liquid can be used to flow around the exterior of flow tubes. For convenience, the terms "upper" and "lower" and "top" and "bottom" are used herein to differentiate between the upper and lower ends of the heat exchanger and particular elements. It is to be appreciated that "upper" and "lower" and "top" and "bottom" are used only for ease of description and understanding and that they are not intended to limit the possible spatial orientations of the heat exchanger or its components during assembly or use.

Heat exchanger 10 includes a first tank 12 having a first reservoir 14 formed therein. In the illustrated embodiment, first tank 12 is a lower or bottom tank of heat exchanger 10. A second tank 16 having a second reservoir 18 formed therein is positioned opposite first tank 12, and is referred to in the illustrated embodiment as an upper or top tank of heat exchanger 10.

In certain embodiments, a web 15 extends vertically within first reservoir 14 between the tube side wall and tank side wall of first tank 12, thereby dividing first reservoir into a first portion 14A and a second portion 14B. A corresponding web 15 is formed in second tank 16, dividing second reservoir 18 into first portion 18A and second portion 18B.

Webs 15 provide additional strength for first tank 12 and second tank 16, which can be subjected to significantly high pressures during operation of heat exchanger 10. It is to be appreciated that more than one web 15 can be provided within first tank 12 and second tank 16, and that webs 15 can extend in any desired direction.

Each of a plurality of tube-and-fin assemblies 19 includes a flow tube 20, and a plurality of fin elements or fins 22 secured to an exterior surface of each flow tube 20. Flow tubes 20 extend between first tank 12 and second tank 16. Fins 22 may be welded or otherwise secured to the exterior of flow tubes 20.

Each tube 20 is mounted at a first or lower end 24 to a first or lower mounting block 26 and at a second or upper end 28 to a second or upper mounting block 30. First and second mounting blocks 26, 30, are secured to first and second tanks 12, 16, respectively. In the illustrated embodiment, first and second mounting blocks 26, 30 are secured to first and second tanks 12, 16 by way of fasteners, such as bolts 32 that are received in threaded recesses 33. It is to be appreciated that first and second mounting blocks 26, 30 can be secured to first and second tanks 12, 16 by other fasteners or any other fastening means. Other suitable fastening means will become readily apparent to those skilled in the art, given the benefit of this disclosure.

Adjacent first mounting blocks 26 are configured and mounted to first tank 12 such that they abut one another along sides thereof, which helps to keep them in position when they are subject to the large pressures often produced within such heat exchangers 10. Adjacent second mounting blocks 30 are similarly mounted and configured such that their sides abut one another as well. Positioning the mounting blocks in abutting relationship provides a structural advantage for heat exchanger 10, since the mounting blocks include apertures extending therethrough, as described below, and providing multiple mounting blocks abutting one another provides strength to one another to help withstand the high operating pressures of the heat exchanger.

Figure 3:
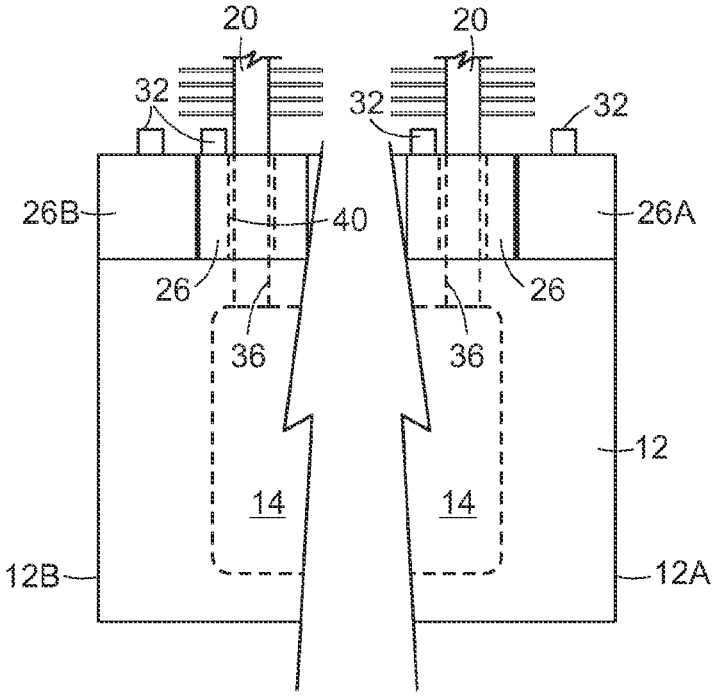
FIG. 3 is an elevation view, shown partially broken away, of end mounting blocks secured to the first tank of the heat exchanger of FIG. 1, which are positioned adjacent mounting blocks that receive tube-and-fin assemblies.

As seen in FIG. 3, at a first end 12A of first tank 12, a first end mounting block 26A is secured to first tank 12 with fasteners such as bolts 32. First end mounting block 26A does not have an aperture extending therethrough for receiving a tube-and-fin assembly, and serve to provide additional structural support for heat exchanger 10. First end mounting block 26 abuts and provides support for an endmost first mounting block 26.

Similarly, at a second end 12B of first tank 12, a second end mounting block 26B is secured to first tank 12 with fasteners such as bolts 32. Second end mounting block 26B is also free of an aperture for receiving a tube-and-fin assembly.

It is to be appreciated that first and second end mounting blocks 26A, 26B may have a fastener at each end of the block as well as another in the middle of the block, and, in certain embodiments, may have additional fasteners to securely fasten the block to first tank 12. It is also to be appreciated that second tank 16 may have similar first and second end mounting blocks secured thereto.

First and second tanks 12, 16 are also fixed with respect to one another by a frame of heat exchanger 10 (not shown). Examples of tube-and-fin element designs useful in the present invention are shown in U.S. Pat. Nos. 4,216,824; 4,344,478; 4,570,704; 5,433,268; and 5,236,045, each of which is hereby incorporated by reference in its entirety for all purposes.

A plurality of rows 34 of apertures 36 are formed in and extend through a tube side wall 38 of first tank 12. Apertures 36 provide fluid communication between first reservoir 14 and tubes 20. As illustrated here, one row 34 of apertures 36 is visible, since a corresponding first mounting block 26 and tube 20 are not positioned over row 34 in order to illustrate the orientation of apertures 36 in row 34. Only two first mounting blocks 26, and corresponding tubes 20 and second mounting blocks 30, are shown secured to first tank 12 in FIG. 1 for illustration purposes. However, it is to be appreciated that heat exchanger 10 can have any desired number of mounting blocks and corresponding tubes 20.

It is to be appreciated that in certain embodiments, each row 34 could have a single larger aperture extending through tube side wall 38 rather than a plurality of smaller apertures 36. However, providing multiple apertures 36 in tube side wall 38 can provide a structural advantage over providing a single larger aperture, since it leaves intact more material of tube side wall 38, thereby providing additional strength for tube side wall 38 to help withstand the high operating pressures of heat exchanger 10. The same would apply to second tank 16.

In certain embodiments, as illustrated in FIG. 1, tank side wall 39 of first tank 12 and second tank 16 are curved or arched below and above first portions 14A, 18A and second portions 14B, 18B of first and second tanks 12, 16, respectively, in order to provide increased strength and resistance for the high pressures encountered within heat exchanger 10. In certain embodiments, vertically extending flanges 41 are positioned along the sides of first and second tanks 12, 16, to provide support for first and second tanks 12, 16 within the frame within which heat exchanger 10 is seated, or on a surface on which heat exchanger 10 is seated.

As shown in FIG. 1, for illustration purposes, the length of tubes 20 is relatively short with respect to both the height of first and second tanks 12, 16, and the height of first and second mounting blocks 26, 30. It is to be appreciated that these proportions are not necessarily applicable for all applications, and that tubes 20 can have any desired length and, in fact, in many applications are significantly longer than the height of first and second tanks 12, 16 and the height of first and second mounting blocks 26, 30. Suitable lengths of tubes 20 will become readily apparent to those skilled in the art, given the benefit of this disclosure.

Figure 2:
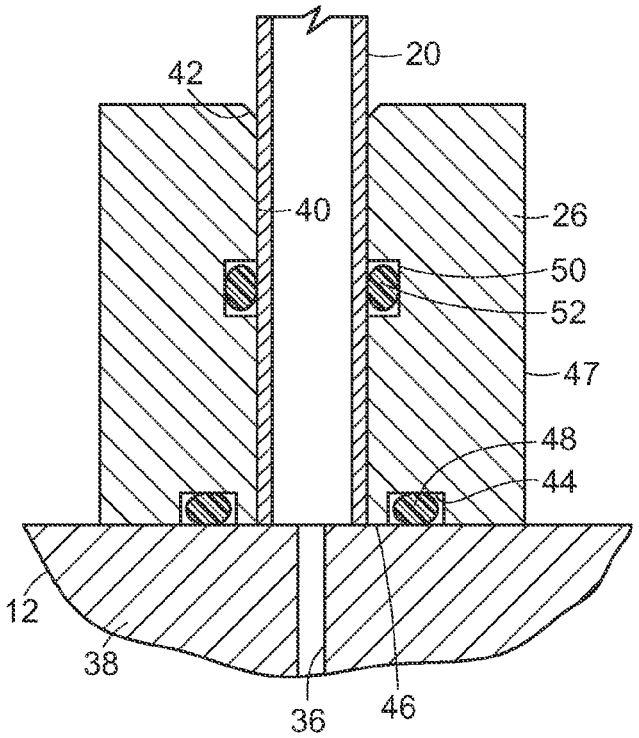
FIG. 2 is a section view of a tube-and-fin assembly of the heat exchanger of FIG. 1, shown received in a mounting block that is secured to a tank.

As seen in FIG. 2, first end 24 of tube 20 is received in an aperture 40 that extends through first mounting block 26. In certain embodiments, an upper peripheral edge 42 of aperture 40 is beveled, or chamfered, in order to facilitate insertion of tube 20 into aperture 40. In certain embodiments, beveled edge 42 is beveled at angle of about 45°.

A first channel or groove 44 is formed in a tank side 46 (seen here as a bottom surface) of first mounting block 26. First channel 44 is positioned in tank side 46 between first aperture 40 and an exterior surface 47 of first mounting block 26. A first seal 48 is received in and contained within first groove 44 and provides a sealing effect between first mounting block 26 and first tank 12.

A second channel or groove 50 is formed on the interior surface of aperture 40. A second seal 52 is received in and contained within second groove 50 and provides a sealing effect between tube 20 and first mounting block 26.

In use, seals 48, 52 are compressed a predetermined amount to provide a proper seal between the tube 20, first mounting block 26, and first tank 12. It is to be appreciated that seals 48, 52 can have differing sizes and shapes. For example, the seals could have a circular cross-section, such as those seals commonly known as "O-rings." Other useful seals include those having a square or rectangular cross-section or a cross-section resembling that of an "X." Other suitable seal shapes will become readily apparent to those skilled in the art, given the benefit of this disclosure, and the configuration of the elements within which the seal is seated.

In certain embodiments, seals 48, 52 are fashioned from an elastomeric material. In certain applications, seals 48, 52 are formed of a material that is suitable for long term exposure to elevated temperatures, which may degrade elastomeric materials. A flexible graphite type material, for example, may provide a long life span when exposed to elevated temperatures. Useful seals are capable of withstanding operating pressures and temperatures of a given heat exchanger, and are also resistant to degradation by fluids used in a given heat exchanger. The seals may be installed by hand or by suitable instrument so as to seat the seal into a given location. Other suitable materials used to form seals 48, 52 will become readily apparent to those skilled in the art, given the benefit of this disclosure.

It is to be appreciated that second end 28 of tube 20 is received in a corresponding aperture formed in second mounting block 30, with the lower peripheral edge of this aperture being beveled, or chamfered, as well. Second mounting block 30 includes first and second grooves that correspond to those formed in first mounting block 26, with corresponding seals being received therein. Since the construction and configuration of the apertures, grooves, and seals of second mounting block 30 are mirror images of those illustrated in FIG. 2 with respect to first mounting block 26, a separate illustration of these elements of second mounting block 30 is not needed here.

Figure 4:
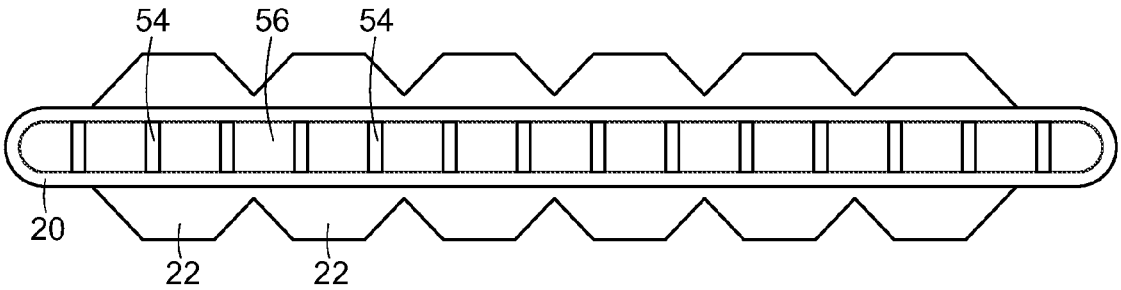
FIG. 4 is a plan view of the tube-and-fin assembly of the heat exchanger of FIG. 1.

In certain embodiments, as seen in FIG. 4, tube 20 includes a plurality of vertically extending interior walls 54 that cooperate with tube 20 to define a plurality of channels 56 through which the heated fluid flows.

Figure 5:
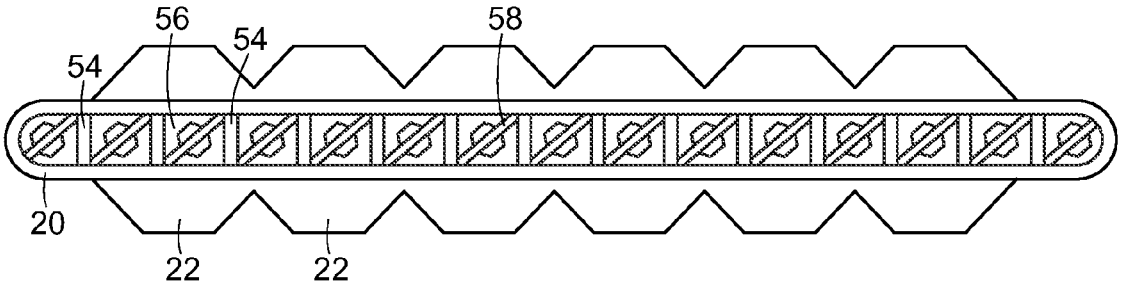
FIG. 5 is a plan view of an alternative embodiment of the tube-and-fin assembly of FIG. 4, including baffle plates seated in channels of the tube.

In certain embodiments, as seen in FIG. 5, one or more baffle plates 58 may be seated in a corresponding channel 56. As illustrated in FIG. 5, a baffle plate 58 is seated in each channel 56. However, it is to be appreciated that while one or more channels 56 may include a baffle plate 58, one or more channels 56 may be free of a baffle plate 58.

Figure 6:
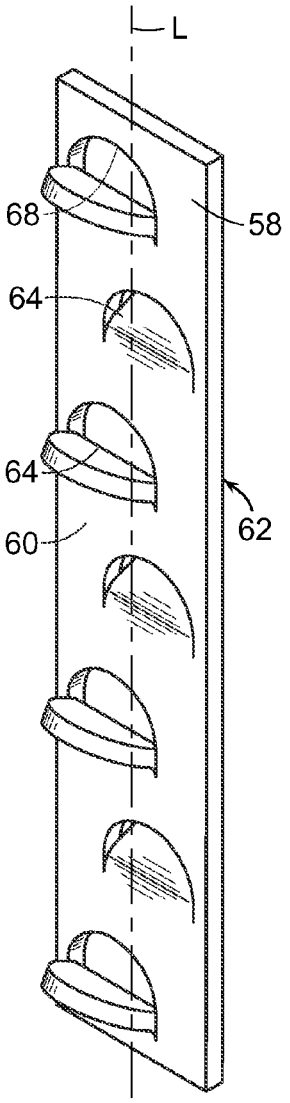
FIG. 6 is a perspective view of a baffle plate of FIG. 5.
Figure 7:
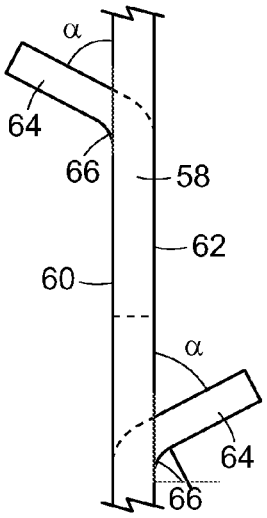
FIG. 7 is an elevation view, shown partially broken away, of the baffle plate of FIG. 6.

An embodiment of a baffle plate 58 having a longitudinal axis L, first surface 60, and an opposed second surface 62 is shown in FIG. 6. Plate 58 has a plurality of tabs 64 extending outwardly from each of first surface 60 and second surface 62 of plate 58. Tabs 64 extend outwardly at an angle $\alpha$ with respect to the surface from which they extend, as seen in FIG. 7. In certain embodiments, angle $\alpha$ is an acute angle. Angle $\alpha$ may be, in certain embodiments, an angle of approximately 45 degrees.

In certain embodiments, each tab 64 is formed by cutting plate 58 and bending a portion of plate 58 outwardly, forming a crease 66 at the joint where tab 64 is bent away from plate 58, and leaving behind a plate aperture 68. Although tabs 64 may be formed by securing separate pieces of material to plate 58, such as by welding, in which case crease 66 would extend along the line of intersection of tab 64 and plate 58, forming tabs 64 by bending a portion of plate 58 outwardly removes the welds as a potential point of failure of plate 58. In embodiments where tabs 64 are secured to plate 58, plate 58 could be cut and a portion of plate 58 removed to produce each plate aperture 68.

It is also to be appreciated that tabs 64 may have a shape other than the substantially hemispherical shape shown in FIG. 6, e.g., substantially rectangular, circular, oval, or any other suitable shape which will become obvious to those skilled in the art, given the benefit of this disclosure.

Plate 58 is oriented within tube 20 such that its longitudinal axis L extends substantially parallel to a longitudinal axis of a channel 56. As the heated fluid flows through tube 20 it is deflected by tabs 64, increasing the turbulence of the flow within tube 20. The increased turbulence in tube 20 thereby enhances the heat transfer from the heated fluid, through tube 20, to the air flowing by fins 22.

Plate 58 may be oriented such that the leading edge of each tab 64, that is, the edge that is upstream with respect to the flow of heated fluid through tube 20, is the outermost edge of tab 64 with respect to plate 58. Correspondingly, in this embodiment, the trailing edge of each tab 64, that is, the edge that is downstream with respect to the flow of heated air through tube 20, is crease 66, where tab 64 joins plate 58.

Conversely, plate 58 may be oriented so that its leading and trailing edges are reversed, that is, the leading edge will be crease 66 and the trailing edge will be the outermost edge of tab 64 with respect to plate 58. Thus, crease 66 of each tab 64 is one of upstream or downstream, with respect to the flow of heating fluid, of the main body of its tab 64. In certain preferred embodiments, plate 58 may have one or more tabs 64 oriented such that their leading edge is crease 66 and one or more tabs oriented such that their trailing edge is crease 66. In either orientation, the outwardly extending tabs 64 serve to deflect the heated fluid flowing through tube 20, thereby increasing turbulence and enhancing heat transfer.

It is to be appreciated that in certain embodiments, tubes 20 may have cross-sectional shapes other than the racetrack shaped tube shown in FIG. 5. For example, tubes 20 may have a circular or oval cross-section. Other suitable cross-sectional shapes for tubes 20 will become readily apparent to those skilled in the art, given the benefit of this disclosure.

Figure 8:
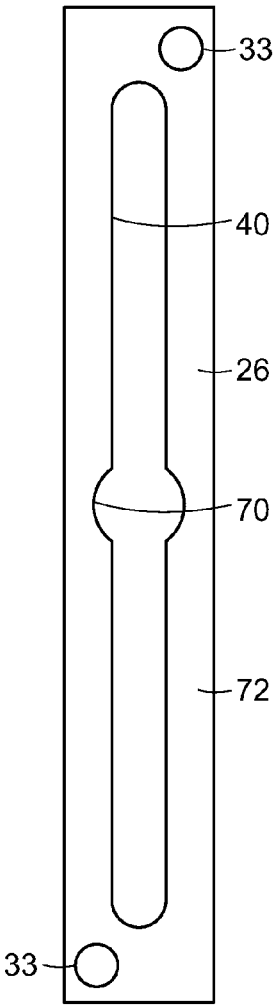
FIG. 8 is a plan view of a mounting block of the heat exchanger of FIG. 1.

As can be seen in FIG. 8, in certain embodiments, a first keyhole 70 extends inwardly from a tube side 72 of first mounting block 26 into first aperture 40, providing access for a cutting tool that is used to form second channel 50 within first aperture 40. It is to be appreciated that a corresponding second keyhole is formed in a tube side of second mounting block 30 for the same reason.

Thus, while there have been shown, described, and pointed out fundamental novel features of various embodiments, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is the intention, therefore, to be limited only as indicated by the scope of the claims appended hereto.

What is claimed is:

1. A heat exchanger assembly comprising:

a first tank having a tube side wall and a first reservoir formed therein; a first row of constant diameter apertures extending through the tube side wall of the first tank;

a first mounting block secured to the first tank and having a first aperture extending therethrough and a first channel formed in a tank side of the first mounting block, the first channel being spaced from an exterior of the first mounting block and from the first aperture, and a second channel formed on a surface of the first aperture, the second channel being spaced from a top and a bottom of the aperture;

a flow tube having a plurality of fins on an exterior surface thereof, a first end, and a second end, the first end being received in the first aperture of the first mounting block and positioned outwardly of an exterior surface of the tube side wall of the first tank;

a first mounting block seal seated in the first channel of the first mounting block and engaging the first tank;

a second mounting block seal seated in the second channel of the first mounting block and engaging the first end of the flow tube;

a second tank having a tube side wall and a second reservoir formed therein; a second row of constant diameter apertures extending through the tube side wall of the second tank; and a second mounting block secured to the second tank and having a second aperture extending therethrough and a second first channel formed in a tank side of the second mounting block, the second first channel being spaced from an exterior of the second mounting block and from the second aperture, and a second second channel formed on a surface of the second aperture, the second second channel being spaced from a top and a bottom of the second aperture, the second end of the flow tube being received in the second aperture of the second mounting block and positioned outwardly of an exterior surface of the tube side wall of the second tank;

a second first mounting block seal seated in the second first channel of the second mounting block and engaging the second tank; and a second second mounting block seal seated in the second second channel of the second mounting block and engaging the second end of the flow tube;

wherein the flow tube is in fluid communication with the first reservoir by way of the first row of apertures and in fluid communication with the second reservoir by way of the second row of apertures.

2. The heat exchanger assembly of claim 1, further comprising:

at least one additional first row of apertures extending through the tube side wall of the first tank, each additional first row of apertures extending substantially parallel to the first row of apertures;

at least one additional first mounting block secured to the first tank having a tube side wall and a first aperture extending through the tube side wall of the at least one additional first mounting block;

at least one additional flow tube having a plurality of fins on an exterior surface thereof, a first end, and a second end, the first end of each additional flow tube being received in a corresponding first aperture of a corresponding additional first mounting block;

at least one additional second row of apertures extending through the tube side wall of the second tank; and at mounting least one additional second mounting block secured to the second tank, having a tube side wall and a second aperture extending through the tube side wall of the second additional block, the second end of each additional flow tube being received in a corresponding second aperture of a corresponding additional second mounting block.

3. The heat exchanger assembly of claim 1, wherein the flow tube includes a plurality of channels formed therein.

4. The heat exchanger assembly of claim 3, further comprising at least one baffle plate positioned in one of the channels.

5. The heat exchanger assembly of claim 4, wherein each baffle plate includes a first surface, an opposed second surface, a plurality of tabs, each tab extending outwardly from one of the first and second surfaces of the baffle plate, and a plurality of plate apertures extending through the baffle plate.

6. The heat exchanger assembly of claim 5, wherein each of the tabs comprises a portion of the baffle plate which is bent outwardly away from one of the first and second surfaces and defines one of the plate apertures.

7. The heat exchanger assembly of claim 5, wherein each of the tabs is substantially hemispherical.

8. The heat exchanger assembly of claim 1, wherein the first and second mounting block seals are O-rings.

9. The heat exchanger assembly of claim 1, wherein the first mounting block is secured to the first tank with at least one first fastener and the second mounting block is secured to the second tank with at least one second fastener.

10. The heat exchanger assembly of claim 5, wherein a tube side of each of the first aperture formed in the first mounting block and the second aperture formed in the second mounting block is beveled.

11. The heat exchanger assembly of claim 1, further comprising:

a first web formed in the first tank and defining a first portion and a second portion of the first reservoir; and a second web formed in the second tank and defining a first portion and a second portion of the second reservoir.

12. The heat exchanger of claim 11, wherein the first web extends between the tube side wall and a tank side wall of the first tank, and the second web extends between the tube side wall and a tank side wall of the second tank.

13. A heat exchanger assembly comprising:

a first tank having a tube side wall, a tank side wall, a first reservoir formed therein, and a first web extending between the tube side wall and the tank side wall defining first and second portions of the first reservoir;

a plurality of first rows of constant diameter apertures extending through the tube side wall of the first tank;

a plurality of first mounting blocks secured to the first tank, each first mounting block having a first aperture extending therethrough and a first channel formed in a tank side of the first mounting block, the first channel being spaced from an exterior of the first mounting block and from the first aperture, and a second channel formed on a surface of the first aperture, the second channel being spaced from a top and a bottom of the first mounting block;

a first mounting block seal seated in the first channel of each first mounting block and engaging the first tank;

a plurality of flow tubes, each flow tube having a plurality of fins on an exterior surface thereof, a first end, and a second end, the first end being received in the first aperture of a corresponding first mounting block and positioned outwardly of an exterior surface of the tube side wall of the first tank;

a second mounting block seal seated in the second channel of each first mounting block and engaging the first end of the flow tube;

a second tank having a tube side wall, a tank side wall, a second reservoir formed therein, and a second web extending between the tube side wall and the tank side wall defining first and second portions of the second reservoir;

a plurality of second rows of constant diameter apertures extending through the tube side wall of the second tank;

a plurality of second mounting blocks secured to the second tank, each second mounting block having a second aperture extending therethrough and a second first channel formed in a tank side of the second mounting block, the second first channel being spaced from an exterior of the second mounting block and from the second aperture, and a second second channel formed on a surface of the second aperture, the second second channel being spaced from a top and a bottom of the second mounting block, the second end of one of the flow tubes being received in the second aperture of each of the second mounting blocks and positioned outwardly of an exterior surface of the tube side wall of the second tank;

a second first mounting block seal seated in the second first channel of each second mounting block and engaging the second tank; and a second second mounting block seal seated in the second second channel of each second mounting block and engaging the second end of the flow tube;

wherein the flow tube is in fluid communication with the first reservoir by way of the first row of apertures and in fluid communication with the second reservoir by way of the second row of apertures.

14. The heat exchanger assembly of claim 13, wherein the first and second tank mounting block seals are O-rings.

15. The heat exchanger assembly of claim 13, further comprising;

a plurality of channels formed in each of the flow tubes; and a plurality of baffle plates, each baffle plate positioned in one of the channels and including a first surface, an opposed second surface, a plurality of tabs, each tab extending outwardly from one of the first and second surfaces of the baffle plate, and a plurality of plate apertures extending through the baffle plate.

16. A heat exchanger assembly comprising:

a first tank having a tube side wall and a first reservoir formed therein;

at least one constant diameter aperture extending through the tube side wall of the first tank;

a first mounting block secured to the first tank and having a first aperture extending therethrough and a first channel formed in a tank side of the first mounting block, the first channel being spaced from an exterior of the first mounting block and from the first aperture, and a second channel formed on a surface of the first aperture, the second channel being spaced from a top and a bottom of the first aperture;

a flow tube having a plurality of fins on an exterior surface thereof, a first end, and a second end, the first end being received in the first aperture of the first mounting block and positioned outwardly of an exterior surface of the tube side wall of the first tank;

a first mounting block seal seated in the first channel of the first mounting block and engaging the first tank;

a second mounting block seal seated in the second channel of the first mounting block and engaging the first end of the flow tube;

a second tank having a tube side wall and a second reservoir formed therein;

at least one constant diameter aperture extending through the tube side wall of the second tank;

a second mounting block secured to the second tank and having a second aperture extending therethrough and a second first channel formed in a tank side of the second mounting block, the second first channel being spaced from an exterior of the second mounting block and from the second aperture, and a second second channel formed on a surface of the second aperture, the second second channel being spaced from a top and a bottom of the second aperture, the second end of the flow tube being received in the second aperture of the second mounting block and positioned outwardly of an exterior surface of the tube side wall of the second tank;

a second first mounting block seal seated in the second first channel of the second mounting block and engaging the second tank;

a second second mounting block seal seated in the second second channel of the second mounting block and engaging the second end of the flow tube;

a first end mounting block secured to the first tank adjacent the first mounting block and free of apertures that receive flow tubes; and a second end mounting block secured to the second tank adjacent the second mounting block and free of apertures that receive flow tubes.

* * * * *